US006634068B1

(12) United States Patent
Kuster et al.

(10) Patent No.: US 6,634,068 B1
(45) Date of Patent: Oct. 21, 2003

(54) APPARATUS FOR PREPARING A FABRIC FOR SEAMING

(75) Inventors: Heinz Kuster, Sandpoint, ID (US); Stephan Kuster, Sagle, ID (US)

(73) Assignee: AstenJohnson, Inc., Charleston, SC (US)

( * ) Notice: Subject to any disclaimer, the term of this patent is extended or adjusted under 35 U.S.C. 154(b) by 0 days.

(21) Appl. No.: 10/128,799

(22) Filed: Apr. 24, 2002

(51) Int. Cl.[7] ..... D03D 49/70; D06C 13/00

(52) U.S. Cl. ..... 26/11; 26/10.4; 26/7; 28/170; 28/145

(58) Field of Search ..... 26/7, 8 R, 10.4, 26/11, 12; 28/142, 145, 146, 170, 171, 141; 30/287, DIG. 8; 83/861, 743, 746, 747, 613, 697; 139/302, 291 C

(56) References Cited

U.S. PATENT DOCUMENTS 934,585 A * 9/1909 Trafford ..... 26/11
1,611,776 A * 12/1926 Piepenbring ..... 26/7
2,572,143 A * 10/1951 Hazelton ..... 26/7
2,664,920 A * 1/1954 Riddle ..... 26/11
3,135,298 A * 6/1964 Marks ..... 26/10.4
3,198,216 A * 8/1965 Ancet et al. ..... 139/302
3,489,184 A * 1/1970 Bernath ..... 139/291 C
4,736,499 A 4/1988 Kopcke
4,974,300 A * 12/1990 Vohringer ..... 28/141
5,027,483 A * 7/1991 Anderson ..... 28/141
5,134,759 A * 8/1992 Hacker et al. ..... 28/141
5,268,076 A 12/1993 Best et al.
5,360,656 A 11/1994 Rexfelt
5,411,063 A * 5/1995 Hacker et al. ..... 28/141
5,785,818 A 7/1998 Fekete
5,864,931 A 2/1999 Best et al.
6,014,797 A 1/2000 Kuster et al.
6,450,210 B2 * 9/2002 Schiller et al. ..... 139/302

* cited by examiner

*Primary Examiner*—Amy B. Vanatta
(74) *Attorney, Agent, or Firm*—Volpe and Koenig, P.C.

(57) ABSTRACT

An integrated cutter for preparing the edges of a fabric for seaming includes a hooked needle which oscillates vertically in a guide bushing located close to the plane of the fabric between a retracted position where the head of the needle is not exposed and an extended position in which the needle penetrates the fabric. The needle head is shaped so that when it moves upwardly it pushes between a pair of yarns in one direction until the hook is above a yarn in the other direction. The needle hook includes a transverse groove shaped so that when it moves downwardly it captures this yarn. The needle is a close fit within the guide bushing, to ensure cooperation between cutting edges at the lateral ends of the transverse groove and at the periphery of the hole at the top end of the guide bushing around the needle, so that a short length of the trapped yarn is severed cleanly as the cooperating cutting edges at each side of the hook and at the top end of the guide bushing pass each other when the needle moves downwardly. A carrier moves the device laterally a preset distance, and the cycle is repeated to cut another section of yarn. Since the integrated cutter of this invention does not rely on friction within the fabric to hold the yarn as it is cut, distortion of the adjacent area of the fabric is minimised.

11 Claims, 5 Drawing Sheets

APPARATUS FOR PREPARING A FABRIC FOR SEAMING

FIELD OF THE INVENTION

This invention relates to an apparatus for preparing a woven fabric for seaming. More particularly, the present invention relates to a cutter for the cutting and removal of transverse yarns from a portion of a fabric to provide an area which is used in forming a seam. In most fabrics, the transverse yarns are weft yarns.

BACKGROUND OF THE INVENTION

Many industrial devices require what is effectively a continuous length of woven fabric, for example the fabrics used in a papermaking machine to carry the paper web that is being made; in sequence these are a forming fabric, a press felt fabric and a dryer fabric. Each of these fabrics comprises at least one continuous fabric loop which circulates within each of the forming, press, and dryer sections of the papermaking machine. Although it is possible to weave a fabric for a small machine as a continuous loop, in many applications this is not necessary. Generally, the fabric is woven as a continuous run, cut to a desired length, and the thus formed ends seamed to provide the required loop of fabric.

A woven seam is preferred in forming fabrics, because it can provide a smooth, flat, join which does not alter significantly the drainage properties of the fabric. To create a woven seam, the transverse threads near to the edge of the two ends of the fabric are removed, to provide a fringe consisting of exposed longitudinal yarn ends. The two fringes are then overlayed, and the longitudinal yarns from one end are rewoven into the other end, as far as possible into the same yarn path thus preserving the fabric weave pattern. Alternatively, the exposed yarn ends are woven back into the same fabric end to provide loops, which are joined to each other by a pintle or by a spiral coil.

For some applications, a relatively narrow strip of woven fabric is converted into a loop using the spiral winding technique described by Best, in U.S. Pat. No. 5,268,076, by Rexfelt, in U.S. Pat. No. 5,360,656, and by Fekete, in U.S. Pat. No. 5,785,818. The spirally wound loop of fabric is flattened, and the two ends formed by the folding step are seamed together. A woven seam is not used, instead a length of warp is exposed at the fold line to provide pintle loops; the two ends are joined by interdigitating the pintle loops and inserting a pintle or a plastic spiral.

It is difficult and time consuming to prepare these fabrics for seaming. In the past, the longitudinal and transverse yarns, which are most often the warps and wefts, at the two ends of a length of fabric have been unravelled manually. This is a slow, labour intensive process which must be carried out with considerable care if the fabric adjoining the unravelled portions is not to be damaged. This is particularly true for the fabrics used in modern wide high speed papermaking machines, which can be over 10 meters wide.

It has been proposed to automate this process.

Köpcke, in U.S. Pat. No. 4,736,499 describes a device in which vertically reciprocating needles pull sections of weft thread out of the plane of the fabric which are then cut out by a cutter, to provide a strip across the fabric in which a predetermined length of weft has been removed. A difficulty with the Köpcke machine is that in one pass it can only remove as many weft threads as there are needles provided to pull them out of the plane of the fabric. If a longer length of warp has to be exposed to make the seam, then the machine has to traverse the width of the fabric more than once.

Kuster et al., in U.S. Pat. No. 6,014,797 describe s similar device in which a needle including a hook is used to pull a weft out of the plane of the fabric to be cut by a separate cutter. The machine then moves a preset distance to cut the next weft. A difficulty with the Kuster et al. machine is that it cannot move across the fabric to capture successive wefts which are not parallel to the line of the edge of the fabric. This creates problems when a Kuster et al. machine is used to prepare a spirally wound fabric for seaming, because the wefts in such fabrics are not parallel to the fabric edges.

A further problem common to both the Köpcke and Kuster et al. machines is that a two part cutter unit is used. The wefts are physically pulled out of the plane of the fabric by a hooked needle and a separate cutter severs the deflected length of weft. This complicates the cutting process, because the friction inherent in a heat set weave may not be sufficient to resist the lateral force applied to the fabric by the needle, so that the fabric adjoining the area in which the seam is to be made can become distorted. This is not desirable.

SUMMARY OF THE INVENTION

This invention seeks to overcome these difficulties, and to provide an apparatus for preparing a fabric for seaming in which the methods disclosed by Köpcke and Kuster et al. to move the cutter unit relative to the fabric are utilised, but a different integrated cutter is used. In the following description it is assumed that, as described by both Köpcke and Kuster et al., the fabric area which is being prepared for seaming is carried on suitable surface in a substantially horizontal plane with the cutter unit located beneath the fabric; other orientations could be used if desired.

The integrated cutter of this invention includes a hooked needle which moves in a guide bushing, with the guide bushing top end located very close to the plane defined by the lower surface of the fabric. This integrated cutter can be used both to form an edge fringe for a woven seam in a conventional fabric as described by Kuster et al., to form an area of exposed warp yarns to provide pintle loops to be joined by a pintle or a plastic spiral as described by Köpcke, and to prepare the ends of a flattened loop of spiral wound fabric for seaming.

In the integrated cutter of this invention, a hooked needle oscillates vertically into and.out of the fabric in a guide bushing supported by a carrier beneath the fabric. The needle oscillates between a retracted position where the head of the needle is not exposed and an extended position in which the needle penetrates the fabric. The upper end of the guide bushing is more or less in contact with the lower surface of the fabric. The needle head is shaped so that when it moves upwardly it pushes between a pair of yarns in one direction, for example warp yarns, with minimal, if any, damage to either of them, until the hook is above a yarn in the other direction, for example a weft yarn. The needle hook includes a transverse groove shaped so that when it moves downwardly it captures this yarn. The needle is a close fit within the guide bushing, to ensure cooperation between cutting edges at the lateral ends of the transverse groove and at the periphery of the hole at the top end of the guide bushing around the needle. Consequently, a short length of the trapped yarn corresponding approximately to the width of the groove in the needle is severed cleanly as the cooperating cutting edges at each side of the hook and at the top end of the guide bushing pass each other. When the needle has moved downwardly to be within the guide bushing, so that the needle head is not exposed, the carrier moves the device laterally a preset distance, and the cycle is repeated to cut another section of yarn. During the cutting process, the fabric is held more or less flat on the supporting surface by a relatively light shuttle, which moves with the carrier supporting the guide bushing. It can thus be seen that the yarns are cut into quite short pieces which fall away beneath the fabric and are trapped, for example by a vacuum system. Further, since the integrated cutter of this invention does not rely on friction within the fabric to hold the wefts as they are cut, distortion of the adjacent area of the fabric is minimised. Additionally, the integrated cutter of this invention can be moved either parallel to, or orthogonal to, the edge of the fabric.

Thus in a broad embodiment this invention seeks to provide an integrated cutter device, for an apparatus for preparing for seaming a selected area of a woven fabric, which fabric has a lower surface adjacent the apparatus and an upper surface remote from the apparatus, and which includes longitudinal and transverse yarns in the weave pattern, the integrated cutter device comprising in combination:

a needle including a shank, a head and a hook located adjacent to the head;

a guide bushing having an axial aperture which is constructed and arranged to be a close fit on the needle shank and which has a first end face;

a shuttle means located on the upper surface of the fabric including a space to receive the head of the needle;

a first carrier means to support the needle and the guide bushing with the first end face of the guide bushing close to the lower surface of the preselected area of fabric;

a second carrier means to locate the shuttle with the space over the guide bushing aperture;

a means to oscillate the needle in the guide bushing between a preselected retracted position and a preselected extended position; and means to move both of the first and the second carrier means together a preselected distance relative to the selected area of fabric, wherein:

(a) the head of the needle is constructed and arranged to be pushed between a pair of yarns in a first direction with minimal damage to either of them;

(b) the hook comprises a shaped groove across the shank of the needle constructed and arranged to trap within the groove one yarn in a second direction in the fabric;

(c) the first and second directions are substantially orthogonal to each other, and one of them corresponds to the direction of the longitudinal yarns;

(d) the shaped groove is formed with a pair of first cutting edges at each of its ends;

(e) the guide bushing first end face is formed with a pair of second cutting edges which cooperate with the pair of first cutting edges;

(f) the needle retracted position is preselected to locate the head of the needle within the guide bushing axial aperture close to the first end face of the guide bushing;

(g) the needle extended position is preselected to locate the needle hook above the upper surface of the fabric; and (h) the preselected distance through which the carrier means are moved together corresponds to a distance NX, in which N is an integral number and X is chosen from the group consisting of the linear spacing between adjacent longitudinal yarns and the linear spacing between adjacent transverse yarns.

Preferably, the guide bushing first end face comprises a replaceable section of harder material to provide the pair of second cutting edges.

Preferably, the needle head has a tapering pointed shape.

Preferably, the needle shank and head have a triangular cross section, the hook groove is located substantially parallel to one of the faces of the triangle and the hook opening is toward the opposite apex of the triangle. More preferably, the needle shank and head have an isosceles triangular cross section, the hook groove is located substantially parallel to the shortest face of the triangle, and the hook opening is toward the opposite apex of the triangle. Most preferably, the needle shank and head have an isosceles triangular cross section, the hook groove is located substantially parallel to a face of the triangle, the hook opening is toward the opposite apex of the triangle and the needle head has a tetrahedral shape.

Preferably, the means to oscillate the needle between the retracted and extended positions comprises a linear motion device. More preferably, the means to oscillate the needle comprises a linear motion device chosen from the group consisting of a solenoid device, a cam device, and an air cylinder. Preferably, the linear motion device comprises an air cylinder. More preferably, the linear motion device comprises a double acting air cylinder.

Preferably, the means to move both of the first and the second carrier means together a preselected distance relative to the selected area of fabric comprises an intermittently actuated lead screw device.

BRIEF DESCRIPTION OF THE DRAWINGS

This invention will now be described with reference to the attached drawings in which.

DETAILED DESCRIPTION OF THE DRAWINGS

Figure 1:
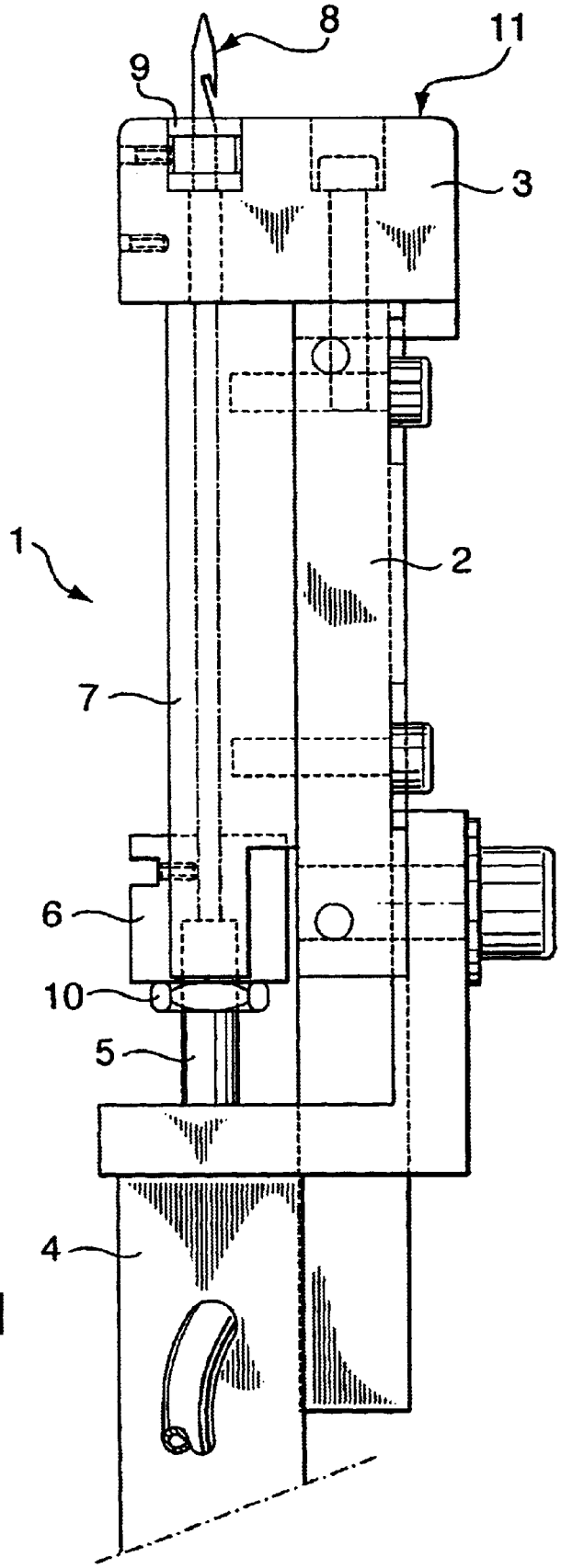
FIG. 1 shows the general arrangement of the integrated cutter device.
Figure 2:
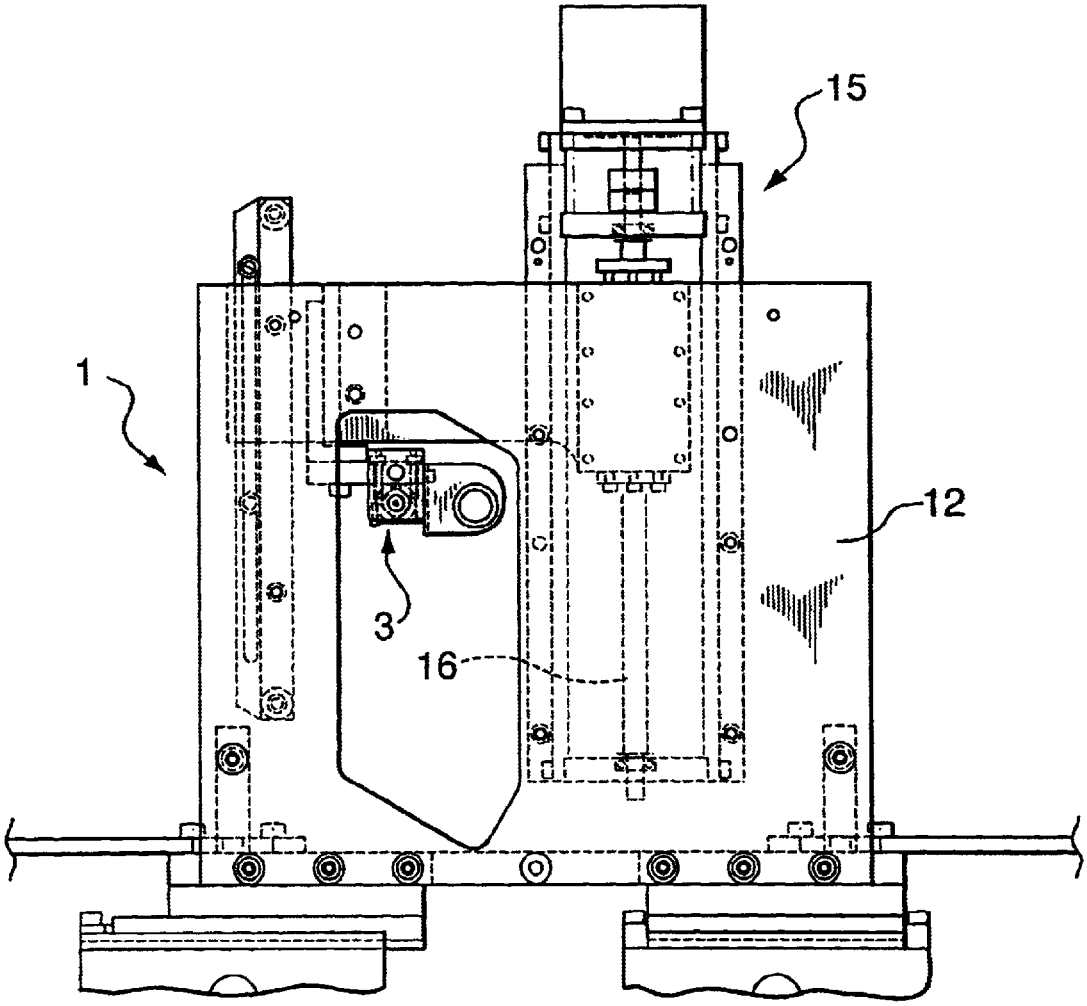
FIGS. 2 and 3 show a top and side view of the integrated cutter of FIG. 1 attached to the carrier means.
Figure 3:
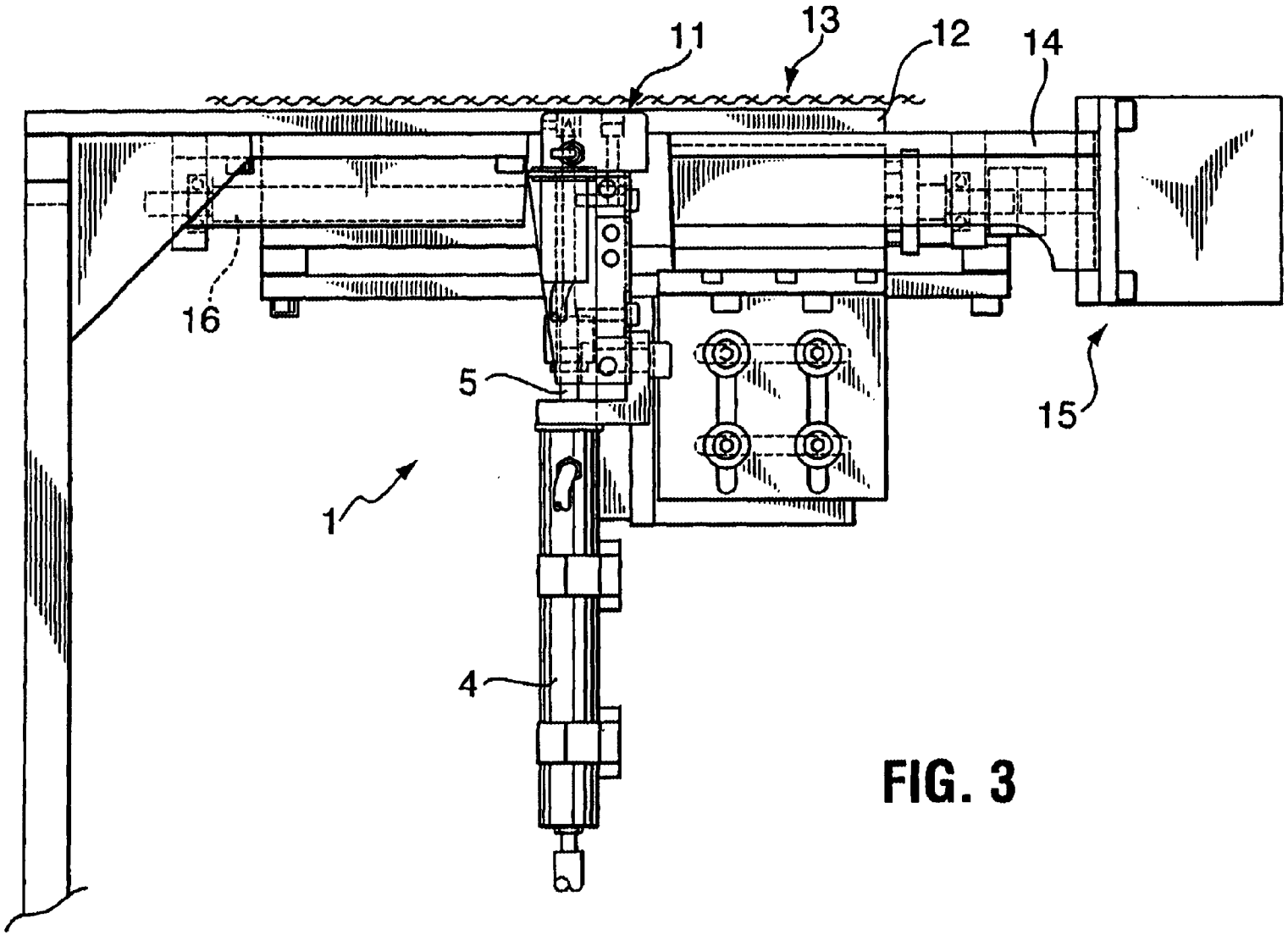

Referring first to FIGS. 1, 2 and 3 the arrangement of an integrated cutter unit according to this invention is shown. The integrated cutter device 1 comprises a mounting bracket 2 which carries the other components. At its top end, the bracket 2 supports the block 3 and at its lower end a linear motion device 4, which in this instance is air cylinder. Other linear motion devices are well known, such as a cam system or a solenoid system, and can be used. The air cylinder piston rod 5 carries a needle holder 6 which is moved in the needle guide 7 by the piston rod 5. The needle 8 is mounted into the holder 6 and through the guide bushing 9 in the block 3. As shown in FIG. 1, the needle is in its extended position. The exact locations of both the extended and retracted positions are adjusted to suit the fabric being prepared for seaming; macro-adjustment is obtained by relocating the air cylinder 4, and microadjustment is obtained by adjusting the position of the holder 7 on the piston rod 5 using the locking nut 10.

The bracket 2 is located so that the top surface 11 of the block 3 is substantially coplanar with the support plate 12 for the fabric, shown in chain line as 13, which is being prepared for seaming(see FIG. 3). The bracket 14 is attached to the support plate 12, to which is attached the lead screw device shown generally at 15. The lead screw unit moves the integrated cutter device relative to the fabric 13 along the lead screw 16; such devices are well known. A second lead screw unit(not shown) is used to move the integrated cutter at a right angle to the unit 15 thus allowing movement of the integrated cutter along the line of either the longitudinal or transverse yarns, which will generally be the warp yarns and the weft yarns respectively.

Figure 4:
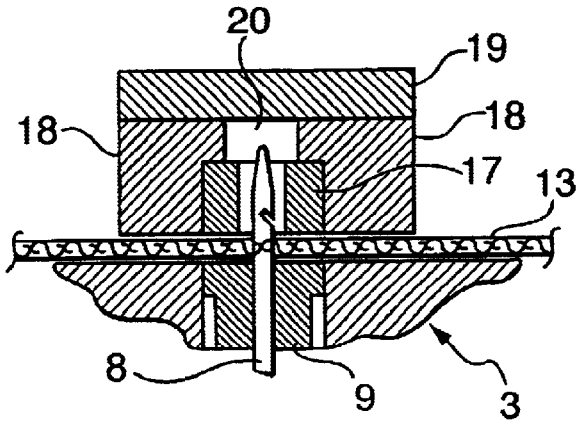
FIG. 4 shows the device used to hold down the fabric.

In order to keep the area of fabric 13 being treated substantially flat, the device shown in FIG. 4 is placed on its upper surface. The device comprises a shuttle 17 with a suitable aperture in it, a hold down device 18, which can be for example a magnet, and a transparent top cover 19. A space 20 is provided within the shuttle, into which the head 21 of the needle 8 penetrates in its extended position.

Figure 5:
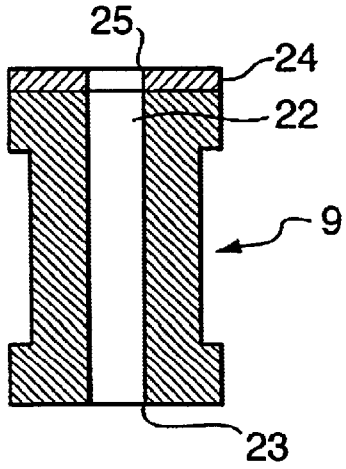
FIG. 5 shows the guide bushing used in the device of FIG. 1.

The cross section of the guide bushing 9 within which the needle 8 oscillates is shown in FIG. 5. The guide bushing 9 is conveniently cylindrical, and conveniently is reversible. The needle 8 oscillates in the aperture 22. As shown at 23 the edge of the aperture is machined to be sharp, and provides the second cutting edge. An alternative structure is shown at the other end of the guide bushing. A thin cutter section 24 of a hard material, such as steel, with a cutting edge 25 is used, which allows the guide bushing 9 to be fabricated from brass or bronze. As the cutting edges wear, the guide bushing or the cutter section, as appropriate, can be reversed relatively easily.

Figure 6:
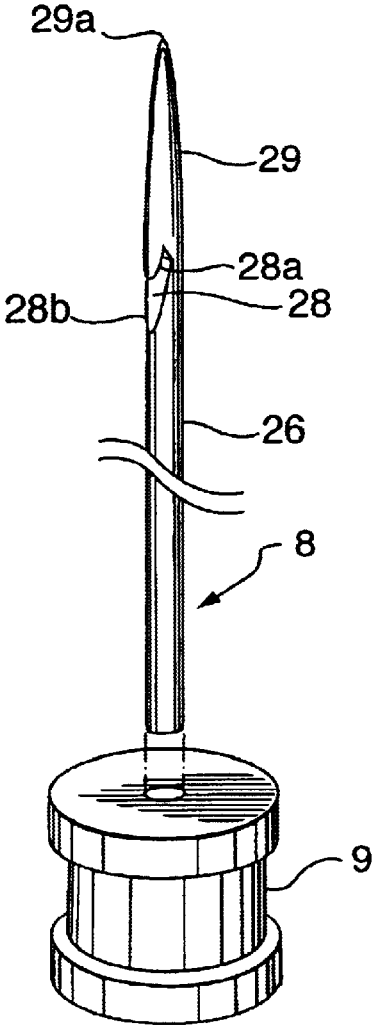
FIG. 6 shows a cylindrical section needle and its cooperating guide bushing.
Figure 7:
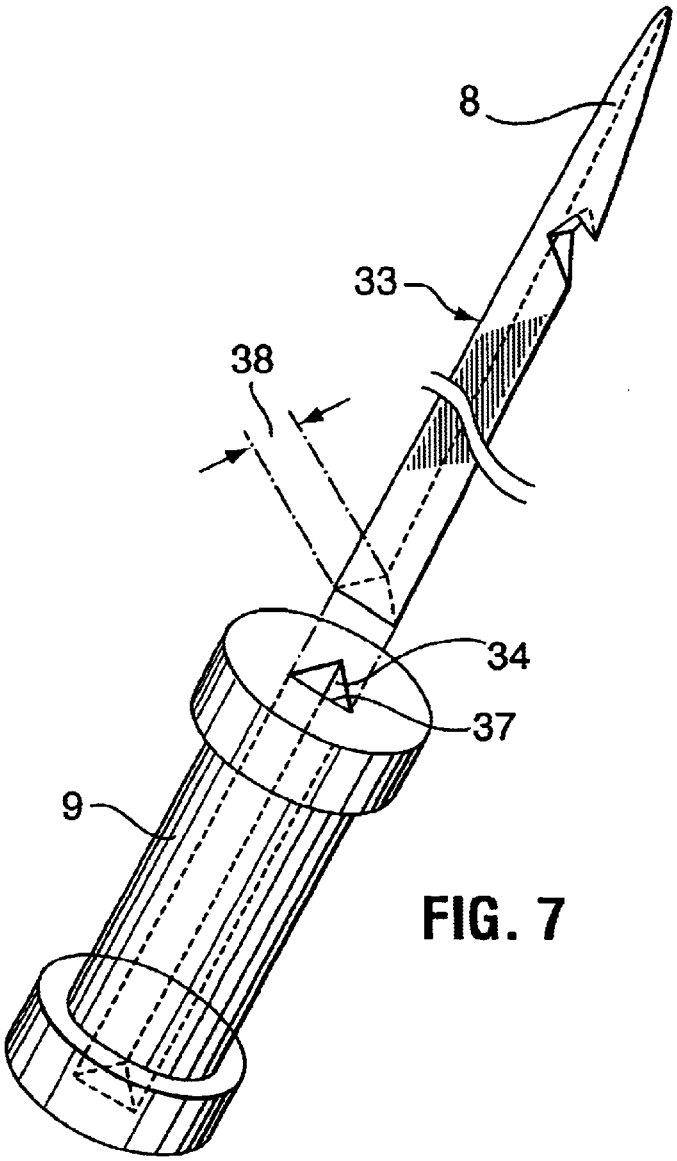
FIG. 7 shows a triangular section needle and its cooperating guide bushing.

The cross sectional shapes of two suitable needle shanks, and of the required cooperating guide bushings, are shown in FIGS. 6 and 7. The main function of the needle cross sectional shape is to ensure that the head of the needle penetrates between adjacent yarns in the first direction, for example a pair of warp yarns, in the fabric, with minimal, if any, damage to any yarns in the first direction which are not to be cut. Additionally, since the first cutting edges are formed in the needle, it is desirable that the needle be shaped so that these adjacent yarns are moved away from the cutting process. Two needle shapes which do this are shown.

Figure 8:
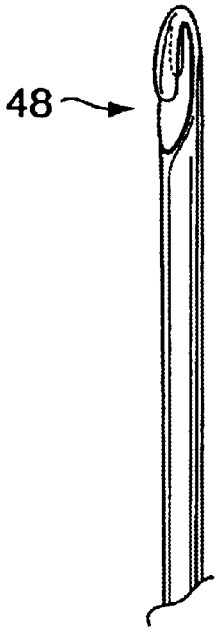
FIG. 8 (Prior Art)
FIG. 8 shows a conventional hooked needle.

In FIG. 6 a modified conventional needle is shown with its guide bushing. The needle 8 has a shank 26, a hook 27 including a shaped groove 28 and a head 29. In this needle, the shank is cylindrical, and the aperture 26A in the guide bushing 9 is also cylindrical. The head 29 is more or less conical, and tapers to a blunt point 29A. In contrast to the conventional cylindrical needle shown in FIG. 8 for comparison, the shaped groove 28 is more or less straight across the body of the needle, with sharp edges at 28A, 28B on each side of the needle. The end edges 23 of the guide bushing 9 are also cut sharp. In FIG. 8 the shaped groove 48 is more or less rounded, without sharp edges at its ends.

In FIG. 7 the needle 8 has a triangular shank 33 and the guide bushing 9 has a triangular aperture 34. The three edges 35, 36 in the needle and 37 in the guide bushing 9 are all made sharp. The groove in the needle 8 is substantially parallel to one side of the triangular cross section of the needle and the hook opening is toward the opposite apex of the triangle. This is the preferred needle shape: the width of the face 38 of the needle spaces the adjacent yarns(not shown) somewhat away from the cutting edges 35, 36 thus minimising damage to them. The triangular cross section of the shank 33 should be one in which the three sides of the shank provide a shaped groove that is sufficiently long to trap a short length of yarn. It is thus preferred that the cross section is at least an isosceles triangle, with the groove substantially parallel to the short face, or more preferably the shape is an equilateral triangle with the groove substantially parallel to one of the faces; in both cases the hook opening faces toward the opposite apex of the triangle.

In the modified needle of this invention it is necessary that the hook will engage the yarn to be cut. This relationship is shown in FIGS. 9, 10 and 11.

Figure 9:
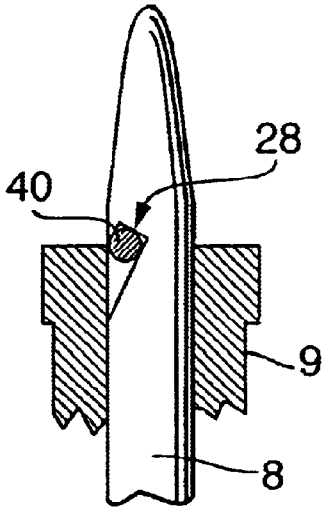
FIGS. 9, 10 and 11 show the relationship between the needle hook and weft yarn diameter.

In FIG. 9 the shaped groove 28 is large enough to trap the yarn 40, ensuring an essentially clean cut between the first and second cutting edges of the needle 8 and guide bushing 9 respectively. When the needle 8 is extended again, the short cut piece of the yarn 40 falls away.

Figure 10:
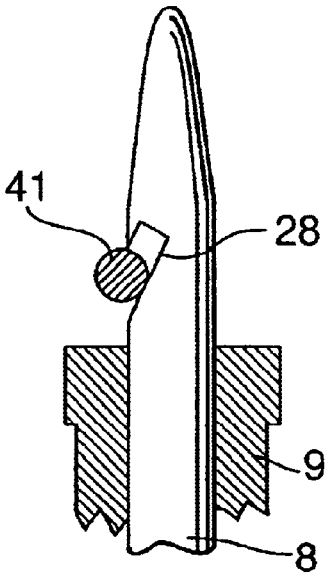
Figure 11:
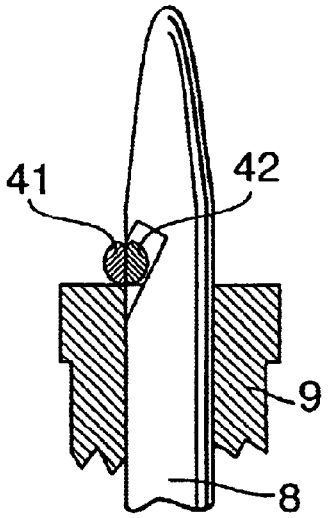

In FIG. 10 the yarn 41 is larger than the shaped groove 28; as can be seen in FIG. 11, although the yarn 41 has been caught by the hook 25 it does not enter fully into the shaped groove 28. The consequence is shown in FIG. 10: the yarn 41 is not cut cleanly, and only a portion 42 of it at best is cut away. It can thus be seen that the dimensions of the shaped groove 28 need to be matched to the yarn 41 to ensure that it will enter the shaped groove 28 for cutting as shown in FIG. 9.

In use, the integrated cutter of this invention moves across the fabric in short steps, which, as noted above, are conveniently controlled by a lead screw device. The cutter can be moved more or less parallel to a selected yarn with each step corresponding to the distance X between successive yarns. Alternatively, the integrated cutter can be moved more or less parallel to a selected yarn with each step corresponding to the distance N times X where X is the distance between successive yarns and N is an integral number and corresponds to the number of yarns desired between each cutting location.

Additionally, due to a combination of the shape of the needle head allowing the needle to nudge apart a pair of adjacent yarns, and the location of the cutting edges very close to the lower surface of the fabric, the integrated cutter of this invention can be used to prepare the folded ends of a spirally wound fabric even though the longitudinal warp yarns and the transverse weft yarns are both at an angle to the fold line corresponding to the angle adopted in the spiral winding process.

We claim:

1. An integrated cutter device, for an apparatus for preparing for seaming a selected area of a woven fabric, which fabric has a lower surface adjacent the apparatus and an upper surface remote from the apparatus, and which includes longitudinal and transverse yarns in the weave pattern, the integrated cutter device comprising in combination:

a needle including a shank, a head and a hook located adjacent to the head;

a guide bushing having an axial aperture which is constructed and arranged to be a close fit on the needle shank and which has a first end face;

a shuttle means located on the upper surface of the fabric including a space to receive the head of the needle;

a first carrier means to support the needle and the guide bushing with the first end face of the guide bushing close to the lower surface of the preselected area of fabric;

a second carrier means to locate the shuttle with the space over the guide bushing aperture;

a means to oscillate the needle in the guide bushing between a preselected retracted position and a preselected extended position; and means to move both of the first and the second carrier means together a preselected distance relative to the selected area of fabric, wherein:

(a) the head of the needle is constructed and arranged to be pushed between a pair of yarns in a first direction with minimal damage to either of them;

(b) the hook comprises a shaped groove across the shank of the needle constructed and arranged to trap within the groove one yarn in a second direction in the fabric;

(c) the first and second directions are substantially orthogonal to each other, and one of them corresponds to the direction of the longitudinal yarns;

(d) the shaped groove is formed with a pair of first cutting edges at each of its ends;

(e) the guide bushing first end face is formed with a pair of second cutting edges which cooperate with the pair of first cutting edges;

(f) the needle retracted position is preselected to locate the head of the needle within the guide bushing axial aperture close to the first end face of the guide bushing;

(g) the needle extended position is preselected to locate the needle hook above the upper surface of the fabric; and (h) the preselected distance through which the carrier means are moved together corresponds to a distance NX, in which N is an integral number and X is chosen from the group consisting of the linear spacing between adjacent longitudinal yarns and the linear spacing between adjacent transverse yarns.

2. An integrated cutter according to claim 1 wherein the guide bushing first end face comprises a replaceable cutter section of harder material to provide the pair of second cutting edges.

3. An integrated cutter according to claim 1 wherein the needle head has a tapering pointed shape.

4. An integrated cutter according to claim 1 wherein the needle shank and head have a triangular cross section, the hook groove is located substantially parallel to one of the faces of the triangle and the hook opening is toward the opposite apex of the triangle.

5. An integrated cutter according to claim 1 wherein the needle shank and head have an isosceles triangular cross section, the hook groove is located substantially parallel to the shortest face of the triangle and the hook opening is toward the opposite apex of the triangle.

6. An integrated cutter according to claim 1 wherein the needle shank and head have an isosceles triangular cross section, the hook groove is located substantially parallel to a face of the triangle, the hook opening is toward the opposite apex of the triangle and the needle head has a tetrahedral shape.

7. An integrated cutter according to claim 1 wherein the means to oscillate the needle between the retracted and extended positions comprises a linear motion device.

8. An integrated cutter according to claim 7 wherein the linear motion device is chosen from the group consisting of a solenoid device, a cam device, and an air cylinder.

9. An integrated cutter according to claim 8 wherein the linear motion device comprises an air cylinder.

10. An integrated cutter according to claim 9 wherein the linear motion device comprises a double acting air cylinder.

11. An integrated cutter according to claim 1 wherein the means to move both of the first and the second carrier means together a preselected distance relative to the selected area of fabric comprises at least one intermittently actuated lead screw device.

* * * * *